US006242715B1

(12) United States Patent
Bichon et al.

(10) Patent No.: US 6,242,715 B1
(45) Date of Patent: Jun. 5, 2001

(54) PROGRESSIVE HOT TWISTING APPARATUS FOR USE IN A PROCESS FOR MANUFACTURING A HOLLOW TURBOMACHINE BLADE

(75) Inventors: Mathieu Philippe Albert Bichon, Ermont; Bernard Armand René Costeplane, Bouglon; Alain Georges Henri Lorieux, Sannois, all of (FR)

(73) Assignees: Societe Nationale d'Etude et de Construction de Moteurs d'Aviation "Snecma", Paris; Etablissements Robert Creuzet, Marmande, both of (FR)

( * ) Notice: Subject to any disclaimer, the term of this patent is extended or adjusted under 35 U.S.C. 154(b) by 0 days.

(21) Appl. No.: 09/290,996

(22) Filed: Apr. 14, 1999

Related U.S. Application Data

(62) Division of application No. 08/914,186, filed on Aug. 19, 1997, now Pat. No. 5,933,952.

(30) Foreign Application Priority Data

Aug. 22, 1996 (FR) ..... 96 10352

(51) Int. Cl.[7] ..... A21B 1/00

(52) U.S. Cl. ..... 219/392; 29/889.72; 228/157; 219/159

(58) Field of Search ..... 219/390, 405, 219/411, 392, 159; 29/889.72, 889.7, 889.721; 228/157; 72/293

(56) References Cited

U.S. PATENT DOCUMENTS 5,063,662 * 11/1991 Porter et al. ..... 29/889.72
5,083,371 * 1/1992 Leibfried et al. ..... 29/889.72
5,099,573 * 3/1992 Krauss et al. ..... 29/889.72
5,253,419 * 10/1993 Collot et al. ..... 29/889.72
5,363,555 * 11/1994 Fowler et al. ..... 29/889.72
5,636,440 6/1997 Bichon et al. .
5,826,332 10/1998 Bichon et al. .
5,896,658 4/1999 Calle et al. .
5,933,951 * 8/1999 Bergue et al. ..... 29/889.72

FOREIGN PATENT DOCUMENTS 0 700 738 3/1996 (EP) .
1578991 8/1969 (FR) .
2 073 631 10/1981 (GB) .
2 080 156 2/1982 (GB) .

OTHER PUBLICATIONS

Patent Abstract of Japan, vol. 8., No. 249 (M–338 [1686], Nov. 15, 1984 & JP 59 125230, Jul. 19, 1984.

* cited by examiner

*Primary Examiner*—Teresa Walberg
*Assistant Examiner*—Shawntina Fuqua
(74) *Attorney, Agent, or Firm*—Oblon, Spivak, McClelland, Maier & Neustadt, P.C.

(57) ABSTRACT

An apparatus for manufacturing a hollow turbomachine blade made from a titanium alloy of the TA6V type includes a hot twisting step in which an element of the blade is twisted progressively at a temperature above 700° C. by a plurality of bars which are rotated about the twist axis and act on collars previously fixed to the element, the distribution and number of collars being determined according to the desired twist to be imparted and such as to obtain a linear twist development between each collar.

3 Claims, 4 Drawing Sheets

PROGRESSIVE HOT TWISTING APPARATUS FOR USE IN A PROCESS FOR MANUFACTURING A HOLLOW TURBOMACHINE BLADE

This application is a division of 08/914,186 filed Aug. 19, 1997, now U.S. Pat. No. 5,933,952.

BACKGROUND OF THE INVENTION

1. Field of the Invention

The present invention relates to an apparatus for manufacturing a hollow turbomachine blade, particularly a large-chord fan rotor blade.

The advantages of using large-chord blades in turbomachines are particularly evident in the case of the fan rotor blades in bypass turbojet engines. These blades must, however, withstand severe conditions of use and, in particular, must possess satisfactory mechanical characteristics associated with antivibratory properties and resistance to impact by foreign bodies. The need for sufficiently high velocities at the tips of the blades has also led to research into reducing the mass of the blades, and this has been achieved, in particular, by the use of hollow blades.

2. Discussion of the Background

EP-A-0700738 describes a process for manufacturing a hollow turbomachine blade, especially a large-chord fan rotor blade. In this known process a first step (a) is to use a computer-aided design and manufacture (CAD/CAM) system to create, starting from the geometric definition of the blade to be obtained, a digital simulation of the primary parts of the blade in flat form and including a computation, for each part, of the lengths of the fibers on each side of the central fiber as a function of their position with respect to the axis of the part. Also carried out at this stage is a digital simulation of an operation to shape the parts by twisting, for comparison with the final result. After this first step EP-A-0700738 teaches a general operating procedure involving the following steps:

(b) die-forging the primary parts of the blade using a press;

(c) machining the primary parts;

(d) depositing diffusion barriers on at least one of the parts according to a predefined pattern;

(e) assembling the primary parts and diffusion welding them together under isostatic pressure;

(f) pressurized gas inflation and superplastic shaping of the welded assembly; and, (g) final machining of the assembly.

One of the aims of the invention is to make it possible to carry out, during the above sequence of operations, an additional shaping of the parts by twisting, without the risk of causing buckling-type undulations along the central fibre. These undulations are generated by compressive stresses induced during elongation of the lateral fibers as a result of the differences in length between the initial flat part and the twisted part which is obtained.

SUMMARY OF THE INVENTION

Accordingly, the invention provides a process for manufacturing a hollow turbomachine blade of the type which is known generally from EP-A-0700738, wherein the process includes a step of hot twisting an element of the blade, which is made of a titanium alloy of the TA6V type, about a twist axis, the hot twisting step comprising prior attachment of collars to said element at positions distributed according to a predetermined twisting law, heating said element to a temperature above 700° C., and causing a plurality of bars to rotate about said twist axis so as to act on said collars to cause progressive twisting of the heated element, the distribution and number of said collars being such as to produce a linear twist development between each collar.

It is known to twist a part, in particular a turbomachine blade, by using means which requires at least one rotating jaw with or without prestressing and in either a hot or a cold state, and in particular by shaping by creep at 950° C., in the case of a blade made of TA6V-type titanium alloy, in an impression under the action of masses which are fixed to the ends of the part and create a torsional moment.

However, these known means are unsuitable for the highly progressive twisting encountered in a process for manufacturing a hollow turbomachine blade having a high compression ratio in the base region of the aerofoil portion of the blade, such as in the case of a large-chord fan rotor blade.

Accordingly, the invention also provides hot progressive twisting apparatus for use in the manufacture of a hollow turbomachine blade having a high compression ratio in the base region of the aerofoil portion of the blade, the apparatus comprising:

a metallic support structure;

a cylindrical electric furnace fixed vertically on said support structure, said furnace having a wall including a plurality of horizontal slots;

a circular frame surrounding said furnace;

a plurality of rings which are free to rotate about said frame;

bars disposed on said rings and projecting inwards through said slots in said furnace wall so as to act on the collars attached to the element which is to be twisted when said element is placed in said furnace; and jaws for gripping opposite ends of said element to hold said element in position in said furnace and enabling a tensile force to be applied to said element along the axis thereof during twisting of said element.

The use of hot progressive twisting apparatus in accordance with the invention for the hot twisting step in the blade manufacturing process makes it possible to avoid the drawbacks of the earlier known processes and to obtain blades possessing improved geometrical and mechanical properties optimized to the conditions of use, and also enables repeat quality to be ensured while facilitating relatively low-cost manufacturing conditions.

Other features and advantages of the invention will become apparent from the following description of the preferred embodiments of the invention with reference to the appended drawings.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
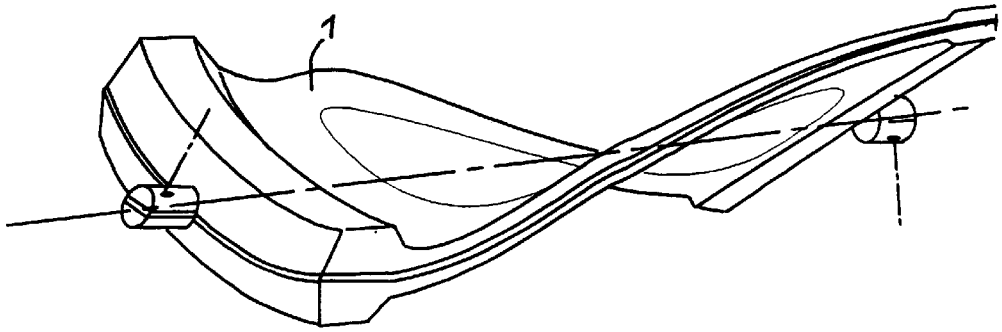
FIG. 1 shows a perspective view of a welded assembly produced during the course of a process in accordance with the invention for the manufacture of a hollow turbomachine blade, the assembly being shown after being hot twisted.

In the manufacture of a hollow turbomachine fan blade by a process in accordance with the invention, the element which is subjected to the hot twisting step may be either a forged primary skin intended to form either the intrados surface or the extrados surface of the blade, or a central metal sheet intended to form stiffeners interconnecting the intrados and extrados surface skins of the blade, or a welded assembly including the outer skins and at least one central metal sheet of the blade, or a welded assembly including an intrados surface skin and an extrados surface skin. In the following description of a non-limiting embodiment of the invention the element is a welded assembly 1 as shown in FIG. 1 after the hot twisting step, the assembly being intended to form a large-chord fan blade for a turbomachine.

The welded assembly 1, which consists of two outer skins separated by an intermediate sheet, is made of a titanium alloy of the TA6V type and is subjected to a hot progressive twisting operation at a temperature of between 700° and 940° C. wherein the assembly is twisted by the action of several bars which are fastened to rings driven by a circular frame rotated about the axis of the assembly and which act on collars clamped to the assembly.

Depending on the final shape of the blade to be obtained and the intended application of the blade, the hot progressive twisting operation may be preceded by a cambering operation in which sections of the blade are shaped.

Depending on the same criteria of the intended application and the final shape of the blade to be obtained, the hot progressive twisting operation may be followed by an operation in which the assembly is inflated by pressurized gas and superplasticly deformed in order to obtain the desired blade profile.

As a variant, after the hot progressive twisting operation, an additional operation of shaping by twisting and sizing may be necessary.

Figure 5:
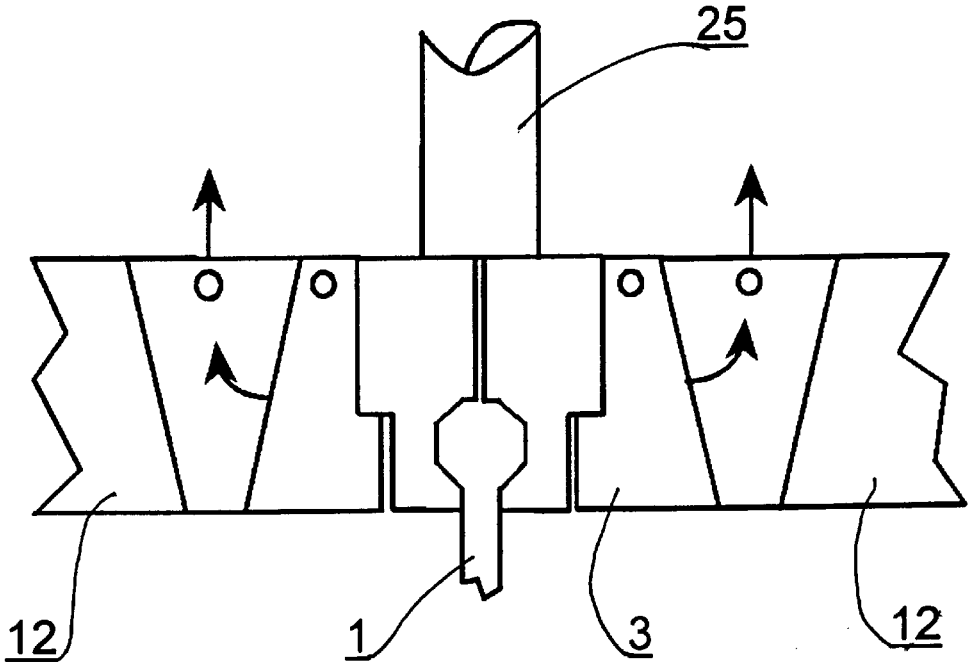
Figure 3:
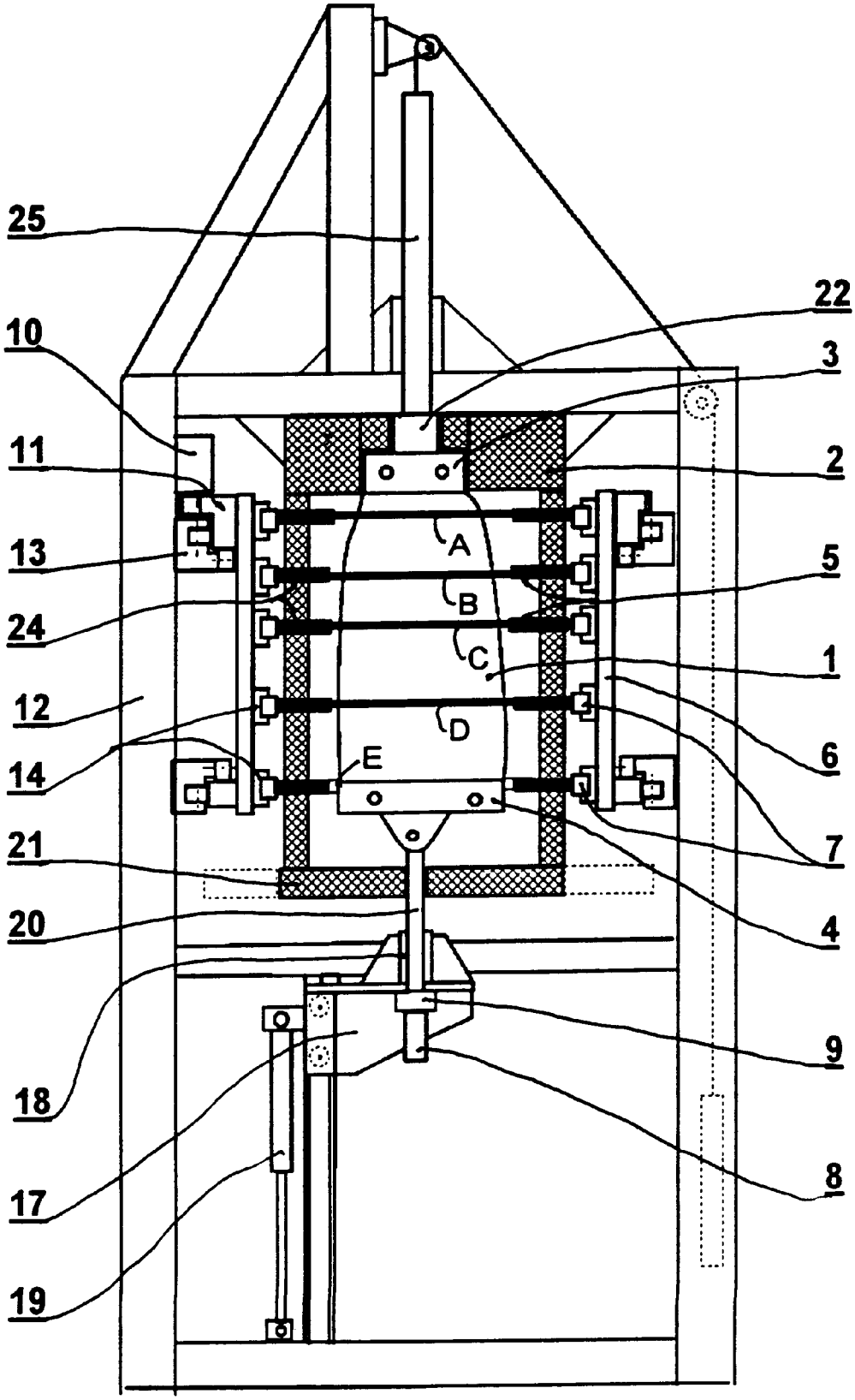
FIG. 3 shows a diagrammatic sectional view of an embodiment of the hot twisting apparatus of the invention.
Figure 4:
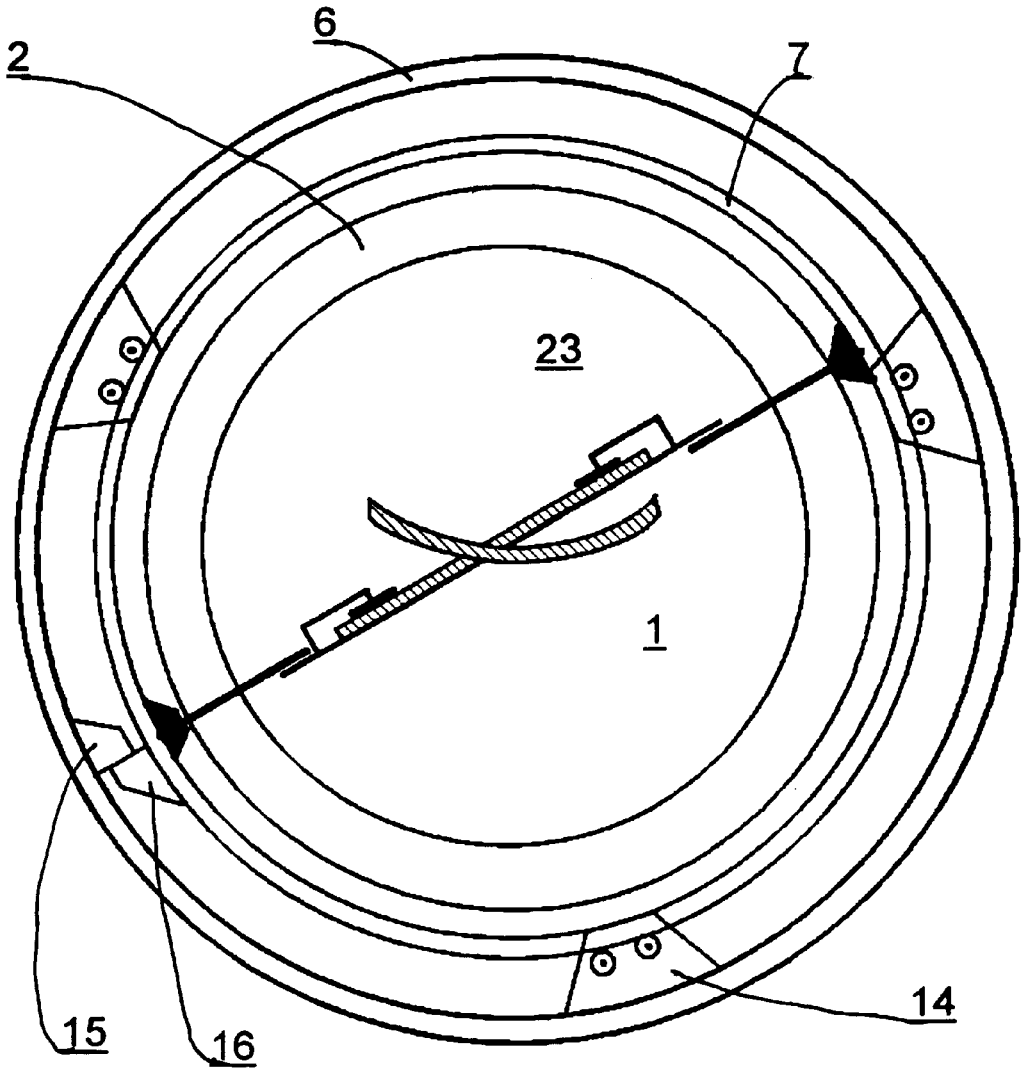
FIG. 4 shows a diagrammatic horizontal section through the hot twisting apparatus of FIG. 3; and, FIG. 5 shows a detail of the twisting apparatus shown in FIGS. 3 and 4.

FIGS. 3 to 5 illustrate hot twisting apparatus which may be used to carry out the operation of twisting the hollow turbomachine blade element 1 in the manufacturing process in accordance with the invention as just described.

This hot progressive twisting apparatus consists of three separate parts: an upper part mainly intended for locking one of the ends of the element 1 by means of two jaws 3, so as to hold it vertically and prevent it from rotating; a central part equipped with an electric furnace 2 and a circular frame 6 which is able to rotate about the furnace and which acts on rings 7 which are free to rotate about the frame and are distributed vertically over the height of the furnace; and a lower part whose main function is to lock the other end of the element 1 in order to ensure that, during twisting, a constant distance is maintained between the two ends by the application of a tensile force by means of a jack 8 which is limited in its travel by a ball thrust bearing 9, the lower part also serving to transfer the element 1 from a loading station into the furnace 2.

The circular electric furnace 2 of the central part is capable of achieving a temperature range of between 700 and 940° C., and is provided with horizontal slots 24 in its wall for the passage of bars 5 which are fastened to the rings 7 and are intended to act on collars 23 which are fitted to the element as may be seen in FIG. 4. Metallic screens lined with fibrous material are placed in line with the slots to ensure that the furnace is sealed. The circular frame 6 is of all-welded tubular construction and is rotationally driven by a variable-speed electric motor 10 via a crown gear 11 fixed to the upper end of the frame 6.

The frame 6 is mounted on a metal support structure 12 by roller bearings 13, and carries as many rings 7 as are necessary according to the law governing the twist which is to be imparted, the rings 7 being free to rotate about the frame by means of roller bearings 14. The frame 6 and the rings 7 are equipped with drive stops 15, 16 positioned so as to apply the necessary angle of twist to each collar 23. The upper part of the furnace incorporates the jaws 3 for clamping the upper end of the element 1, and also permits the passage of a guide rod 25 which links the jaws to the support structure 12. The guide rod 25 is water-cooled, and the clamping jaws 3 are adapted to the shape of the element 1. A locking system including wedges 22 is shown in FIGS. 3 and 5, and makes it possible to position and immobilize the upper end of the element 1 at a fixed position in the furnace, while still enabling the element 1 to be moved vertically from the furnace 2 to the loading/unloading station lying beneath the furnace.

A counterweight system is provided to balance the assembly so that the element is not stressed when unloading it from the furnace.

The lower part of the apparatus, which is operable to transfer the element 1 from the loading/unloading station to the furnace 2 and vice versa, also functions to clamp the lower end of the element 1 by means of two freely rotatable jaws 4 mounted on a rod 20 which is vertically guided in a bush 18 fastened to a carriage 17 which is movable vertically by means of a jack 19. The carriage 17 also carries the thrust bearing system 9 and the jack 8 for applying a tensile force to the element 1 so as to maintain a constant distance between the upper and lower clamping jaws 3 and 4. The jack 8 also makes it possible to absorb the effects of the expansion of the element 1 during heating.

Figure 2:
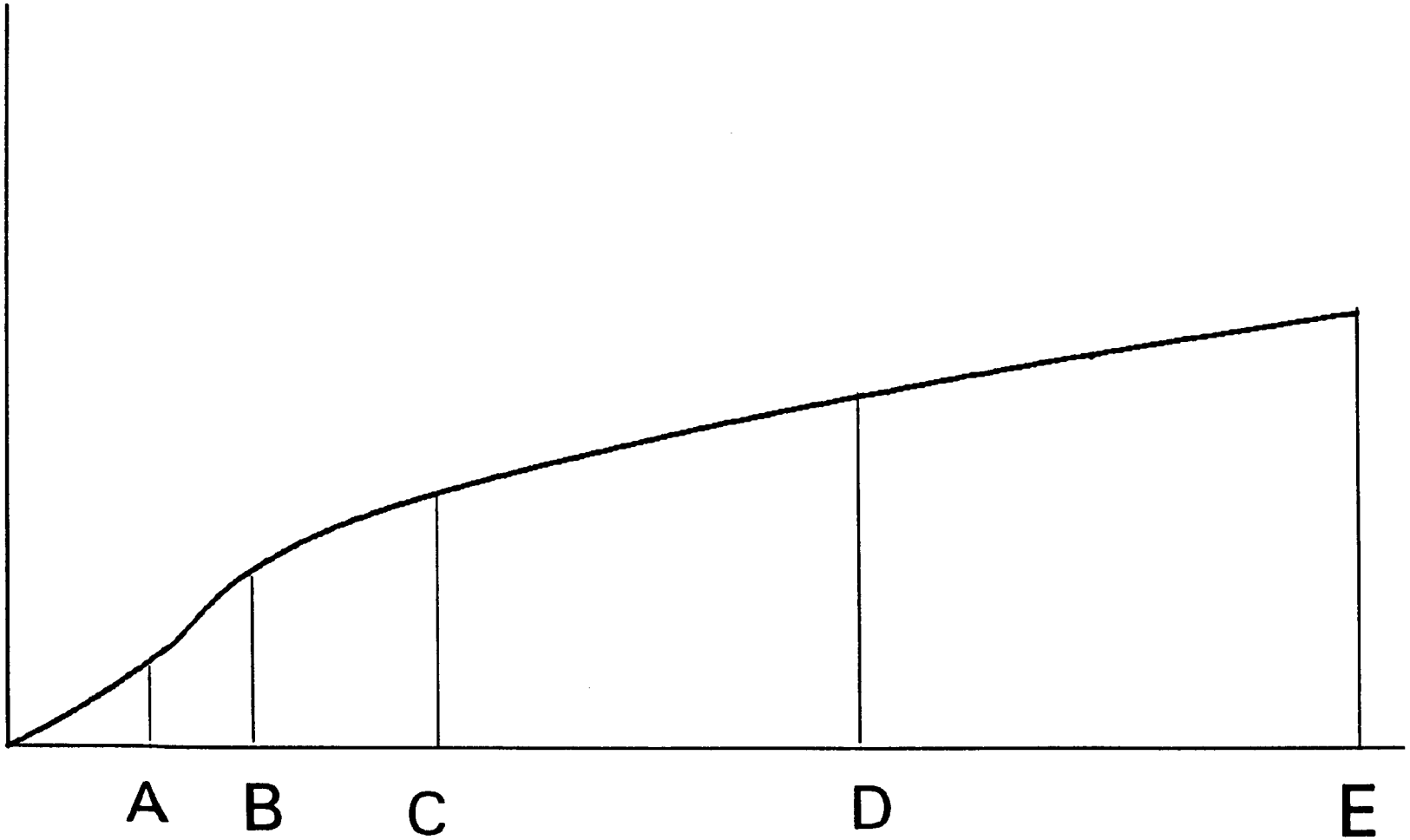
FIG. 2 is an example of a curve representing the development of the twist as a function of the height of the blade and the position of the collars.

The collars 23, which are all-welded mechanical components, are clamped onto the element 1 at positions defined by the twist to be imparted. A preparation table enables them to be correctly positioned on the element. In one exemplary embodiment, FIG. 2 shows the defined positions A, B, C, D, E of the collars 23 as a function of the twist development curve, and these positions are indicated in FIG. 3.

An example of the use of the hot twisting apparatus to progressively twist a welded turbomachine blade assembly 1 will now be described.

The electric furnace 2 is heated to a temperature above 700° C. for an operation involving a TA6V-type titanium alloy, and the jaws 3 and 4 are in the lowered position ready to receive a welded assembly to which collars 23 have been attached at positions distributed over the height of the assembly according to the development of the twist to be imparted, as explained above. As soon as the assembly has been clamped in the jaws 3 and 4, the carriage 17 transfers it into the furnace 2 as far as a predetermined end-of-travel position, and the jaws 3 are immobilized by the locking wedges 22. At this stage, the doors of the furnace 2 are closed, and the welded assembly 1 is held in the furnace 2 until it has reached the twisting temperature. As soon as this temperature is reached, the motor 10 is operated to rotate the circular frame 6 and, by means of the stops 15 and 16 which are arranged according to the angle of twist to be provided, the frame in turn drives the rings 7 so that the bars 5 act on the collars 23 to impress the desired twist on the welded assembly 1. The frame 6 is then driven in reverse to return the rings 7 back to the start-of-cycle position. At this stage, the doors of the furnace are opened and the carriage 17 is lowered to transfer the welded assembly 1 to the loading/unloading station.

What is claimed is:

1. Hot progressive twisting apparatus for use in the manufacture of a hollow turbomachine blade said apparatus comprising:

a metallic support structure;

a cylindrical electric furnace fixed vertically on said support structure, said furnace having a wall including a plurality of horizontal slots;

a circular frame surrounding said furnace;

a plurality of rings which are free to rotate about said frame;

bars disposed on said rings and projecting inwards through said slots in said furnace wall so as to act on the collars attached to the element which is to be twisted when said element is placed in said furnace; and jaws for gripping opposite ends of said element to hold said element in position in said furnace and enabling a tensile force to be applied to said element along the axis thereof during twisting of said element.

2. Apparatus according to claim 1, including a system of wedges for positioning and rotationally immobilizing said jaws which grip the upper end of said element while still ensuring release during transfer operations.

3. Apparatus according to claim 1, wherein the extent of the penetration of said bars into said furnace through said slots can be adjusted.

* * * * *

UNITED STATES PATENT AND TRADEMARK OFFICE

CERTIFICATE OF CORRECTION

PATENT NO. : 6,242,715 B1
DATED : June 5, 2001
INVENTOR(S) : Mathieu Philippe Albert Bichon et al.

It is certified that error appears in the above-identified patent and that said Letters Patent is hereby corrected as shown below:

Column 1,
Line 55, change "fibre" to -- fiber --.

Column 5,
Line 15, insert -- , -- between "blade" and "said".

Signed and Sealed this

Fourth Day of December, 2001

*Attest:*

Nicholas P. Godici

NICHOLAS P. GODICI
*Acting Director of the United States Patent and Trademark Office*

*Attesting Officer*